US007922465B2

(12) United States Patent
Sun et al.

(10) Patent No.: US 7,922,465 B2
(45) Date of Patent: Apr. 12, 2011

(54) COOLING FAN

(75) Inventors: Hong Sun, Shenzhen (CN); Bao-Hua Liang, Shenzhen (CN); Yong-Kang Zhang, Shenzhen (CN); Ying-Min Huang, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 631 days.

(21) Appl. No.: 11/964,790

(22) Filed: Dec. 27, 2007

(65) Prior Publication Data

US 2009/0041601 A1 Feb. 12, 2009

(30) Foreign Application Priority Data

Aug. 8, 2007 (CN) ..... 2007 1 0075636

(51) Int. Cl.
*F04B 35/04* (2006.01)

(52) U.S. Cl. ..... 417/423.12; 417/423.1

(58) Field of Classification Search ..... 417/423.12, 417/423.1

See application file for complete search history.

(56) References Cited

U.S. PATENT DOCUMENTS

| | | | | |
|---|---|---|---|---|
| 5,795,139 | A * | 8/1998 | Ikeda et al. | 417/269 |
| 6,265,798 | B1 * | 7/2001 | Huang et al. | 310/90.5 |
| 6,849,978 | B2 * | 2/2005 | Sun et al. | 310/90.5 |
| 6,982,505 | B2 * | 1/2006 | Horng et al. | 310/51 |
| 7,364,403 | B2 | 4/2008 | Wu et al. | |
| 2005/0275299 | A1 * | 12/2005 | Horng et al. | 310/90.5 |
| 2006/0171620 | A1 * | 8/2006 | Nakagawa et al. | 384/279 |
| 2006/0284503 | A1 * | 12/2006 | Lin et al. | 310/90 |
| 2007/0001523 | A1 * | 1/2007 | Ko et al. | 310/51 |
| 2007/0242911 | A1 * | 10/2007 | Nakagawa et al. | 384/279 |

OTHER PUBLICATIONS

Wang et al., Study on Sintering and Sintering Temperature of Oily Bearing Made of Iron Bronze, Shanghai Nonferrous Metals, Oct. 1995, 264-266, vol. 16, No. 5, published in China.

* cited by examiner

*Primary Examiner* — Devon C Kramer
*Assistant Examiner* — Peter J Bertheaud
(74) *Attorney, Agent, or Firm* — Jeffrey T. Knapp

(57) ABSTRACT

A cooling fan includes a fan housing (10) having a central tube (11) extending upwardly therefrom, a bearing (20) received in the central tube, a stator (40) mounted around the central tube, a rotor (30) having a shaft (37) extending into the bearing, and a magnetic ring (38) being fixedly mounted to the rotor to rotate with the rotor during operation of the cooling fan. The bearing is made of iron-copper alloy. The magnetic ring is made of hard magnetic material and exerts a magnetic attraction on the bearing, whereby the rotor is pulled downwardly by a magnetic attraction of the bearing on the magnetic ring to lessen the floating problem of the rotor during operation of the cooling fan.

10 Claims, 3 Drawing Sheets

COOLING FAN

BACKGROUND OF THE INVENTION

1. Field of the Invention

The present invention relates to a cooling fan, and more particularly relates to a cooling fan with a balancing structure for maintaining stable rotation of a rotor thereof.

2. Description of related art

With the continuing development of the electronic technology, electronic packages such as CPUs (central processing units) are generating more and more heat that requires immediate dissipation. Cooling fans are commonly used in combination with heat sinks for cooling the CPUs.

A conventional cooling fan includes a stator and a rotor having a hub with a plurality of fan blades extending therefrom. The stator establishes an alternating magnetic field interacting with the magnetic field of the rotor to drive the rotor to rotate. The rotation of the rotor causes the fan blades to generate a forced airflow for cooling the electronic packages, such as the CPUs. The stator includes a bearing defining a bearing hole therein. The rotor has a shaft extending into the bearing hole and is thus rotatably supported by the bearing. However, during rotation of the rotor, the rotating fan blades generate an external pressure which pulls the rotor to move upwardly along the axial direction away from the stator, and the rotor is thus kept in a "floating" condition. The floating rotor is inclined to generate a level of noise, which can be unacceptable.

For the foregoing reasons, therefore, there is a need in the art for a cooling fan which overcomes the above-mentioned problems.

SUMMARY OF THE INVENTION

According to a preferred embodiment of the present invention, a cooling fan includes a fan housing having a central tube extending upwardly therefrom, a bearing received in the central tube, a stator mounted around the central tube, a rotor having a shaft extending into the bearing, and a magnetic ring being fixedly mounted to the rotor to rotate with the rotor during operation of the cooling fan. The bearing is made of iron-copper alloy. The magnetic ring is made of hard magnetic material and exerts a magnetic attraction on the bearing, whereby the rotor is pulled downwardly by a magnetic attraction of the bearing on the magnetic ring.

Other advantages and novel features of the present invention will be drawn from the following detailed description of the preferred embodiments of the present invention with attached drawings, in which:

BRIEF DESCRIPTION OF THE DRAWINGS

Many aspects of the present cooling fan can be better understood with reference to the following drawings. The components in the drawings are not necessarily drawn to scale, the emphasis instead being placed upon clearly illustrating the principles of the present cooling fan. Moreover, in the drawings, like reference numerals designate corresponding parts throughout the several views.

DETAILED DESCRIPTION OF THE INVENTION

Figure 1:
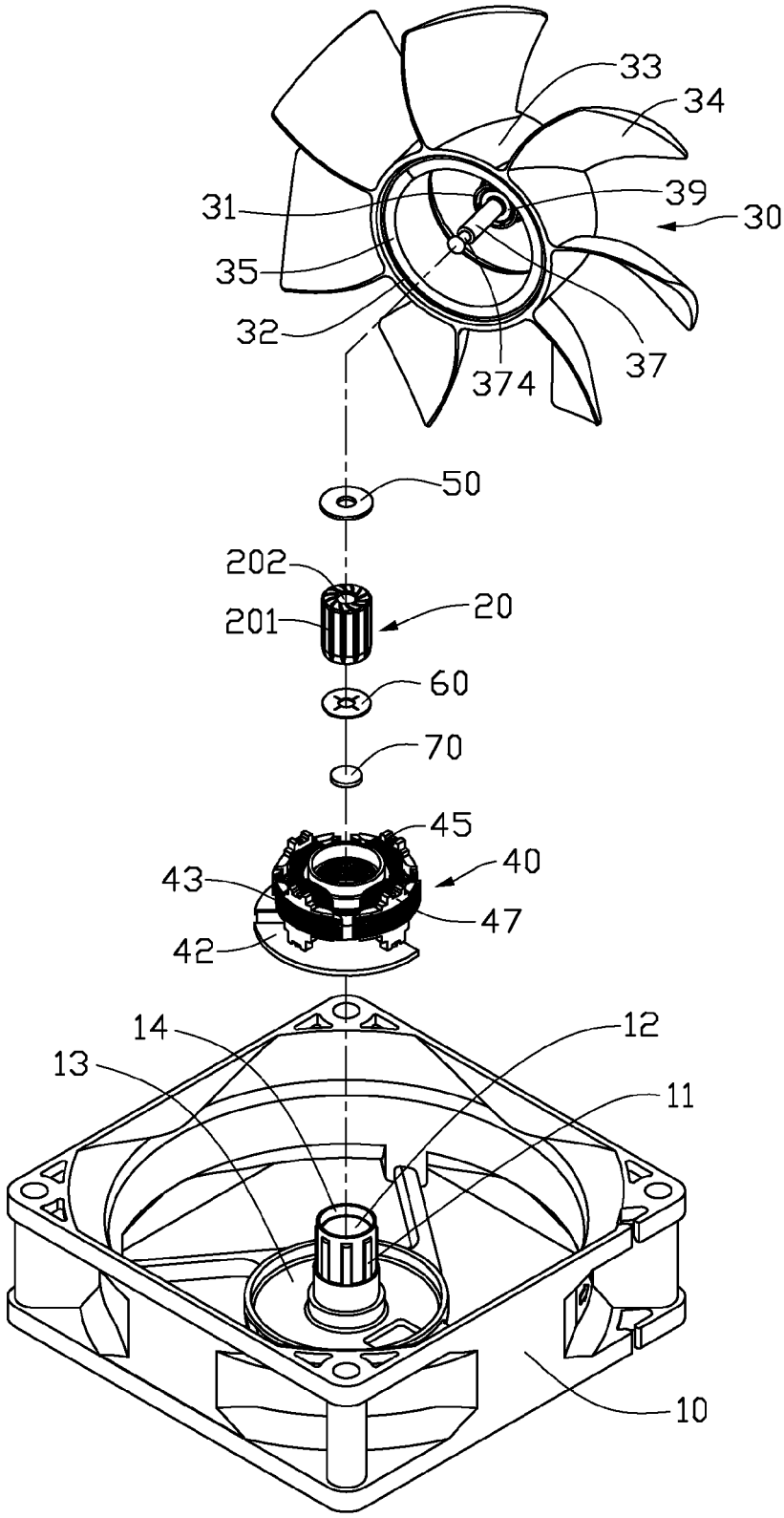
FIG. 1 is an isometric, exploded view of a cooling fan in accordance with a preferred embodiment of the present invention.
Figure 2:
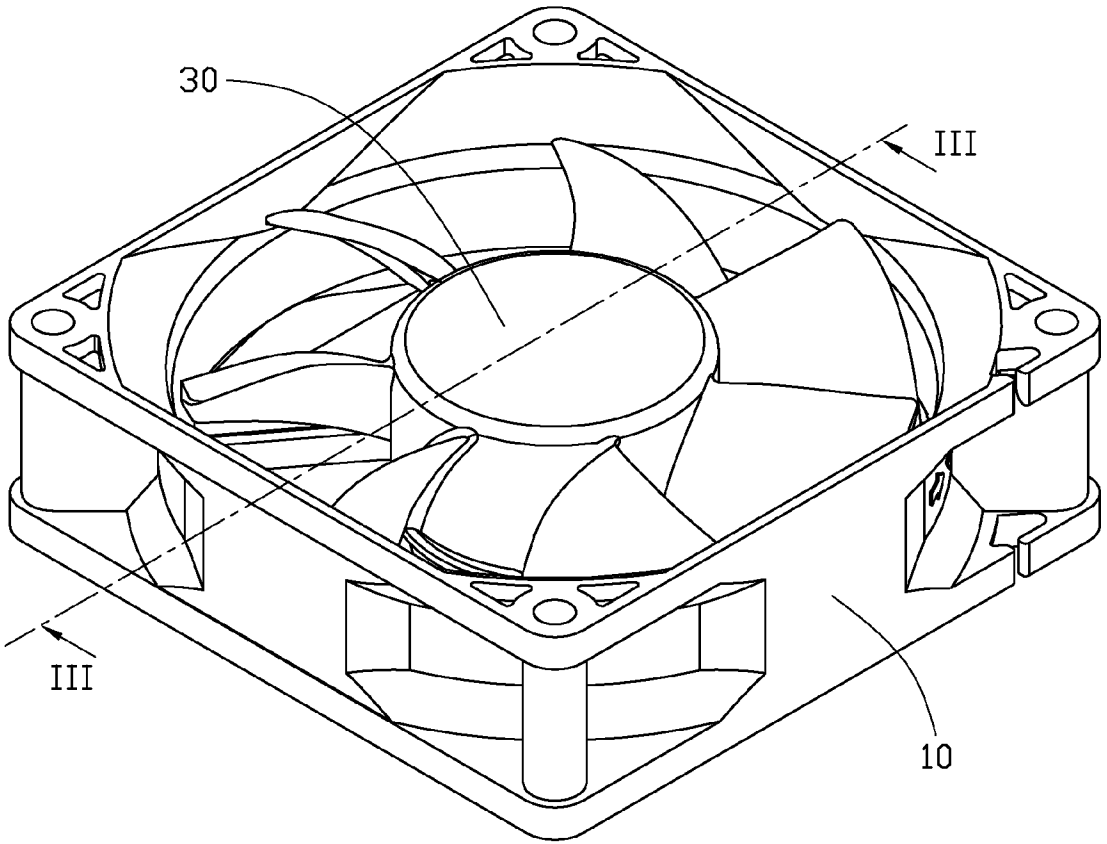
FIG. 2 is an assembled view of the cooling fan of FIG. 1.
Figure 3:
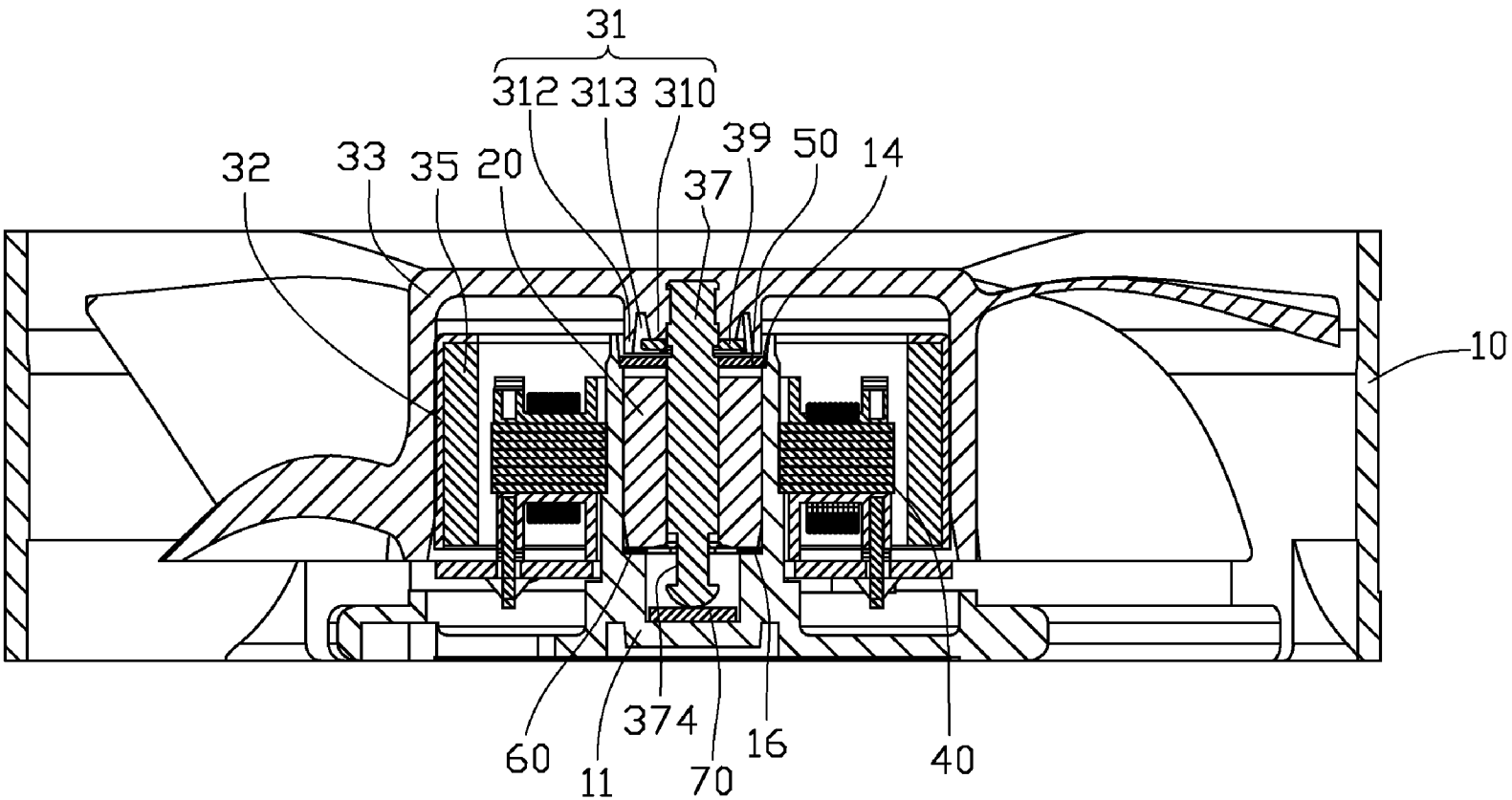
FIG. 3 is a cross-sectional view of the cooling fan taken from line III-III of FIG. 2.

Referring to FIGS. 1 through 3, a cooling fan according to a preferred embodiment includes a fan housing 10, a bearing 20, a magnetic ring 39, a rotor 30, and a stator 40 in respective to which the rotor 30 is rotatable.

The fan housing 10 includes a base 13 and a central tube 11 extending upwardly from a central portion of the base 13. The central tube 11 defines a central hole 12 therein and forms an open end at a top portion thereof. An annular recess 14 is formed on an inner circumference of the top portion of the central tube 11. The recess 14 communicates with the central hole 12. Thus the top portion of the central tube 11 has an inner diameter larger than that of the other portion of the central tube 11. A bottom end of the central tube 11 is closed. An annular protrusion extends inwardly from the inner circumference of the bottom end of the central tube 11, and thus forms a step 16 in the central hole 12 at the bottom end of the central tube 11.

The stator 40 is mounted around the central tube 11 of the fan housing 10. The stator 40 includes a stator core 43 consisting of layered yokes. Stator coils 45 wind on the stator core 43 to establish an alternating magnetic field. A PCB (Printed Circuit Board) 42 with electronic components mounted thereon is electrically connected with the stator coils 45 to control electrical current flowing through the stator coils 45. To avoid the stator coils 45 from coming into electrical contact with the stator core 43, upper and lower insulating frames 47 are used to cover the stator core 43 and electrically insulate the stator coils 45 from the stator core 43.

The rotor 30 includes a hub 33 forming a shaft seat 31 at a central portion thereof, a plurality of fan blades 34 extending radially from an outer periphery of the hub 33, a permanent magnet 35 adhered to an inner side of the hub 33, an annular shell 32 sandwiched between the magnet 35 and the hub 33, and a shaft 37. The shaft seat 31 includes an annular-shaped inner ring 310 and an annular shaped outer ring 312. An annular groove 313 is defined between the inner and outer rings 310, 312. A bottom end of the inner ring 310 is higher than that of the outer ring 312. A top end of the shaft 37 is received in the inner ring 310. A concave is thus defined in the outer ring 312 of the shaft seat 31 around the shaft 37. The shaft 37 extends downwardly from the inner ring 310 and forms a free end (not labeled) opposite to the top end. An annular notch 374 is defined in a circular circumference of the shaft 37 near the free end thereof, and an annular slot (not labeled) is defined near the top end of the shaft 37 adjacent to the hub 33.

The magnetic ring 39 is made of hard magnetic material, such as rare earth permanent magnetic material or ferrite material. The magnetic ring 39 is received in the concave of the shaft seat 31 and is fixedly connected to the bottom end of the inner ring 310 of the shaft seat 31 to rotate with the rotor 30 during operation of the cooling fan. A bottom side of the magnetic ring 39 is approximately at the same level as the bottom end of the outer ring 312 of the shaft seat 31. The magnetic ring 39 defines a through hole for extension of the shaft 37 therethrough, and thus is mounted around the top end of the shaft 37 and is located higher than the slot of shaft 37. It is to be understood that the magnetic ring 39 can also be connected to the shaft 37 to rotate with the rotor 30, and the magnetic ring 39 can be fixedly connected to the shaft seat 31 or the shaft 37 by riveting, soldering, gluing or interference fitting.

The bearing 20 is a sleeve bearing which is formed by sintering iron-copper alloy powders and thus has a plurality of pores (not shown) defined therein. The pores are impregnated with lubricant oil. The copper in the bearing 20 is used to improve the abrasion resistance of the bearing 20. On the other hand, the iron in the bearing 20 can reduce the cost of the bearing 20 and enhance a magnetic attraction that the magnetic ring 39 exerts on the bearing 20. A weight ratio of the iron in the bearing 20 is preferably in a range of 30-50%. In this embodiment, the weight ratio of the iron in the bearing 20 is about 40%. The bearing 20 defines a bearing hole 202 therein for extension of the free end of the shaft 37 therethrough. A plurality of channels 201 are defined in an outer surface of the bearing 20 for flowing back of the lubricant oil into the bearing 20. The channels 201 communicate with the bearing hole 202 of the bearing 20. Each of the channels 201 includes a curve-shaped portion defined in top and bottom end surfaces of the bearing 20 and a linear-shaped portion extending along an axial direction of the bearing 20 in an outside surface of the bearing 20. The curve-shaped portions of the channels 201 in the top end surface of the bearing 20 curve along a rotation direction of the cooling fan. The channels 201 can guide the leaking oil to return back to the bottom end of the bearing 20 from which the leaking oil returns to the bearing hole 202.

When assembling, the stator 40 is mounted around the central tube 11. The bearing 20 is received in the central hole 12 of the central tube 11 and is arranged on the step 16. The top end of the bearing 20 is lower than the top portion of the central tube 11. The rotor 30 is mounted around the stator 40 with the permanent magnet 35 facing the stator core 43. The bottom end of the shaft seat 31 extends into the top portion of the central tube 11. The magnetic ring 39 in the shaft seat 31 is located just over the top end of the bearing 20 with a narrow gap defined therebetween, and a magnetic attraction is thus generated between the magnetic ring 39 and the iron-copper alloy bearing 20. The shaft 37 extends through the bearing hole 202 of the bearing 20 and rotatably engages with the bearing 20. An oil-retaining cover 50 mounted around the shaft 37 is received in the recess 14 of the central tube 11 to seal the top portion of the central tube 11. The oil-retaining cover 50 is located between and spaced from the top end of the bearing 20 and the magnetic ring 39. An oil buffer is thus defined among the oil-retaining cover 50, the bearing 20, the central tube 11 and the shaft 37. The notch 374 of the shaft 37 is located corresponding to the bottom end of the bearing 20. A locking washer 60 is located between the bottom end of the bearing 20 and the step 16 of the central tube 11. The locking washer 60 engages in the notch 374 to limit movement of the shaft 37 along an axial direction thereof. A support pad 70 made of high abrasion resistant material is mounted in a bottom end of the central hole 12 of the central tube 11 to face and supportively engage the free end of the rotary shaft 37.

During operation, the rotor 30 is driven to rotate by the interaction of the alternating magnetic field established by the stator 40 and the magnetic field of the rotor 30. As the rotating fan blades 34 generate an external pressure which pulls the rotor 30 to move upwardly along the axial direction away from the stator 40, the rotor 30 is in a "floating" condition. Since the magnetic ring 39 mounted in the shaft seat 31 of the rotor 30 faces the top end of the iron-copper alloy bearing 20, the magnetic ring 39 exerts a magnetic attraction on the bearing 20 and the bearing 20 also generates a magnetic attraction on the magnetic ring 39. Thus, a magnetic attraction is generated between the magnetic ring 39 and the bearing 20. In other words, the bearing 20 can attract the rotor 30 which is fixedly connected to the magnetic ring 39 to pull the rotor 30 downwardly along the axial direction. Thus the axially upward movement and possible floating of the rotor 30 during rotation of the cooling fan is avoided, and thus the problem of the noise generated by the floating of the rotor 30 during an unstable period of the floating of the rotor 30 can be solved by the present invention, which in turn improves the quality and life-span of the cooling fan. On the other hand, during rotation of the rotor 30, the lubrication oil creeps up along the rotating shaft 37 under the influence of the centrifugal force generated by the rotation of the shaft 37. Since the oil-retaining cover 50 can sufficiently prevent the oil from leaking out therefrom, the oil escaped from the bearing 20 is retained the oil buffer and then flows back to the bearing 20 through the channels 201 of the bearing 20. Therefore the oil can be kept from leaking out of the bearing 20. Good lubrication of the bearing 20 and shaft 37 is thus constantly maintained.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. A cooling fan comprising:

a fan housing having a central tube extending upwardly therefrom;

a bearing received in the central tube, the bearing being made of iron-copper alloy susceptible to a magnetic force;

a stator mounted around the central tube;

a rotor having a shaft extending into the bearing, a hub and a shaft seat extending downwardly from a center of the hub, the shaft seat comprising an inner ring receiving a top end of the shaft and an outer ring being arranged around the inner ring with an annular groove defined therebetween, a bottom end of the outer ring being lower than a bottom end of the inner ring, a concave recess being thus defined in the outer ring of the shaft seat around the shaft; and a magnetic ring being received in the concave recess of the shaft seat and being fixedly connected to the bottom end of the inner ring of the shaft seat and mounted around the top end of the shaft to rotate with the rotor during operation of the cooling fan, a bottom side of the magnetic ring being approximately at the same level as the bottom end of the outer ring of the shaft seat, the magnetic ring being made of hard magnetic material and exerting a magnetic attraction on the bearing, whereby the rotor is pulled downwardly by a magnetic attraction of the bearing on the magnetic ring.

2. The cooling fan as claimed in claim 1, wherein the magnetic ring is made of one of rare earth permanent magnetic material and ferrite material.

3. The cooling fan as claimed in claim 1, wherein a weight ratio of the iron in the bearing is in a range of 30-50%.

4. The cooling fan as claimed in claim 1, wherein a weight ratio of the iron in the bearing is approximately 40%.

5. The cooling fan as claimed in claim 1, wherein the magnetic ring is mounted to the rotor by one of the following methods: riveting, gluing, soldering and interference fitting.

6. The cooling fan as claimed in claim 1, wherein a top end of the bearing is lower than a top end of the central tube, the shaft seat extending into the top end of the central tube, and the magnetic ring facing the top end of the bearing.

7. The cooling fan as claimed in claim 6, wherein an oil-retaining cover is received in the top end of the central tube to seal the top end of the central tube, the oil-retaining cover being located between and spaced from the top end of the bearing and the magnetic ring.

8. The cooling fan as claimed in claim 7, wherein the shaft, the bearing, the central tube, and the oil-retaining cover cooperatively define an oil buffer therebetween, the bearing defining a plurality of channels in an outer surface thereof, the channels communicating with the oil buffer.

9. The cooling fan as claimed in claim 8, wherein each of the channels includes a curve-shaped portion defined in top and bottom end surfaces of the bearing and a linear-shaped portion extending along an axial direction of the bearing in an outside surface of the bearing, the curve-shaped portions of the channels extending along a rotation direction of the cooling fan.

10. The cooling fan as claimed in claim 1, wherein the central tube forms an annular step in the central hole at a bottom end thereof, the bearing is mounted on the step, and a locking washer is arranged between the bearing and the step of the central tube and engages in a notch of the shaft which is defined near a bottom end of the shaft to limit movement of the shaft along an axial direction thereof.

* * * * *